US008422904B2

(12) United States Patent
Maeda et al.

(10) Patent No.: US 8,422,904 B2
(45) Date of Patent: Apr. 16, 2013

(54) IMAGE FORMING APPARATUS

(75) Inventors: Naoya Maeda, Kashiwazaki-shi (JP); Minoru Yamada, Kashiwazaki-shi (JP); Sachie Izawa, Kashiwazaki-shi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 371 days.

(21) Appl. No.: 12/765,547

(22) Filed: Apr. 22, 2010

(65) Prior Publication Data

US 2011/0064446 A1 Mar. 17, 2011

(30) Foreign Application Priority Data

Sep. 16, 2009 (JP) ..... 2009-214468

(51) Int. Cl.
*G03G 15/00* (2006.01)

(52) U.S. Cl.
USPC ..... 399/88; 399/50; 399/110; 399/117; 399/167

(58) Field of Classification Search ..... 399/50, 399/88, 89, 90, 110–113, 116, 117, 159, 399/167, 168
See application file for complete search history.

(56) References Cited

U.S. PATENT DOCUMENTS

| | | | | |
|---|---|---|---|---|
| 2007/0059043 | A1* | 3/2007 | Tanaka | 399/227 |
| 2008/0226345 | A1* | 9/2008 | Yoon | 399/167 |
| 2009/0010678 | A1* | 1/2009 | Kim et al. | 399/111 |

FOREIGN PATENT DOCUMENTS

| | | |
|---|---|---|
| JP | B2-4048771 | 2/2008 |
| JP | B2-4078506 | 4/2008 |

* cited by examiner

*Primary Examiner* — Walter L Lindsay, Jr.
*Assistant Examiner* — Jessica L Eley
(74) *Attorney, Agent, or Firm* — Oliff & Berridge, PLC

(57) ABSTRACT

An image forming apparatus includes: an image forming apparatus main body, a driven member removably disposed in the image forming apparatus main body, a rotary driver that rotates by current flowing, and after the blockage of the current flowing, continuously rotates due to an inertial force, a coupling part that has a driving-side member and a driven-side member, wherein when the driven-side member is mounted to the image forming apparatus main body, the driving-side member and a driven-side member are facing each other, and when the driving-side member and the driven-side member engage each other in the rotating direction, the rotary driver and the driven-side member are coupled to transmit the rotation of the rotary driver to the driven-side member, and a controller that controls so that, when the driven-side member is mounted to the image forming apparatus main body, the current flows to the rotary driver, and after the elapse of a certain period of time the current flow to the rotary driver is blocked.

5 Claims, 8 Drawing Sheets

S10

IMAGE FORMING APPARATUS

CROSS-REFERENCE TO RELATED APPLICATIONS

This application is based on and claims priority under 35 USC 119 from Japanese Patent Application No. 2009-214468 filed Sep. 16, 2009.

BACKGROUND

Technical Field

The present invention relates to an image forming apparatus.

SUMMARY

According to an aspect of the invention, there is provided an image forming apparatus including: an image forming apparatus main body, a driven member removably disposed in the image forming apparatus main body, a rotary driver that rotates by current flowing, and after the blockage of the current flowing, continuously rotates due to an inertial force, a coupling part that has a driving-side member and a driven-side member, wherein when the driven-side member is mounted to the image forming apparatus main body, the driving-side member and a driven-side member are facing each other, and when the driving-side member and the driven-side member engage each other in the rotating direction, the rotary driver and the driven-side member are coupled to transmit the rotation of the rotary driver to the driven-side member, and a controller that controls so that, when the driven-side member is mounted to the image forming apparatus main body, the current flows to the rotary driver, and after the elapse of a certain period of time the current flow to the rotary driver is blocked.

BRIEF DESCRIPTION OF THE DRAWINGS

An exemplary embodiment of the present invention will be described in detail based on the following figures, wherein.

DETAILED DESCRIPTION

First Exemplary Embodiment

The exemplary embodiment of the present invention will be described below with reference to accompanying drawings.

Figure 1:
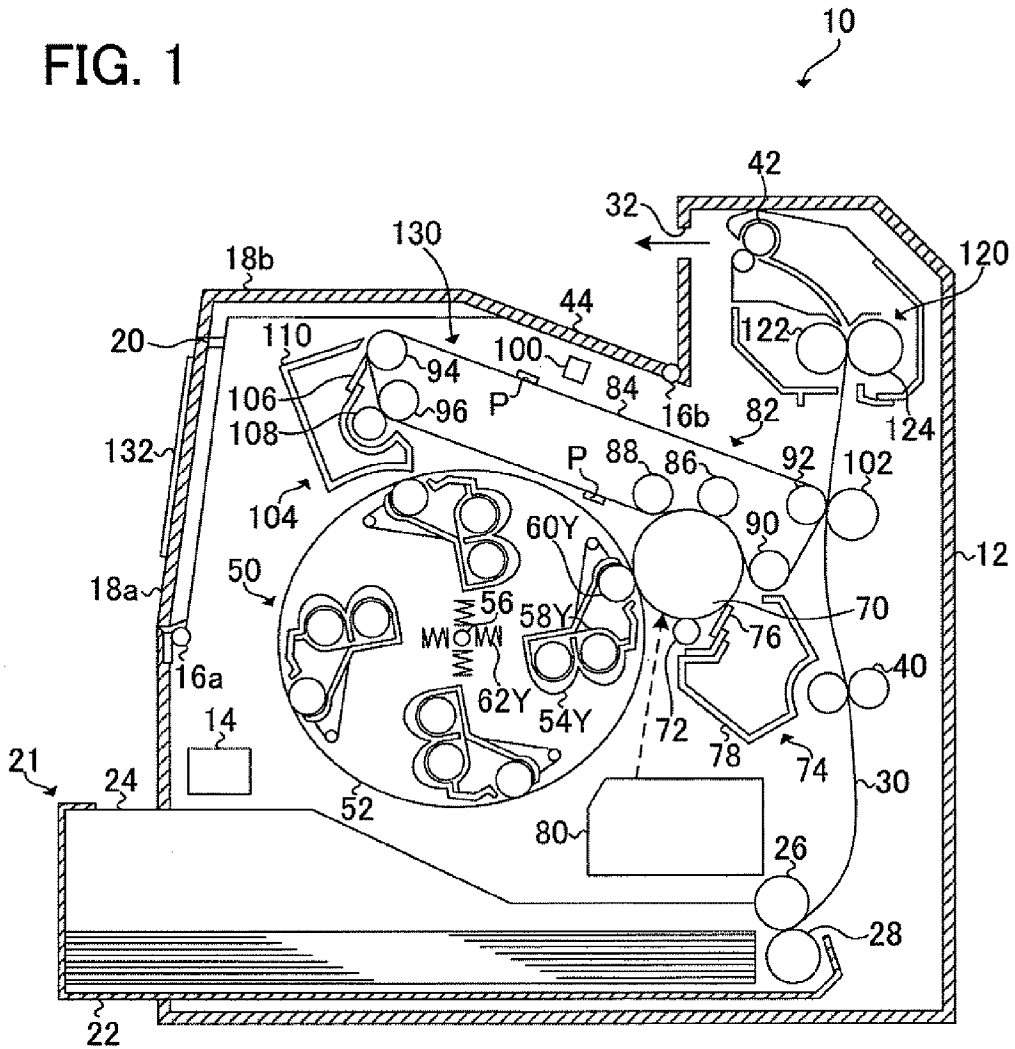
FIG. 1 is a cross-sectional view illustrating an entire configuration of an image forming apparatus 10 according to an exemplary embodiment of the present invention.
Figure 3:
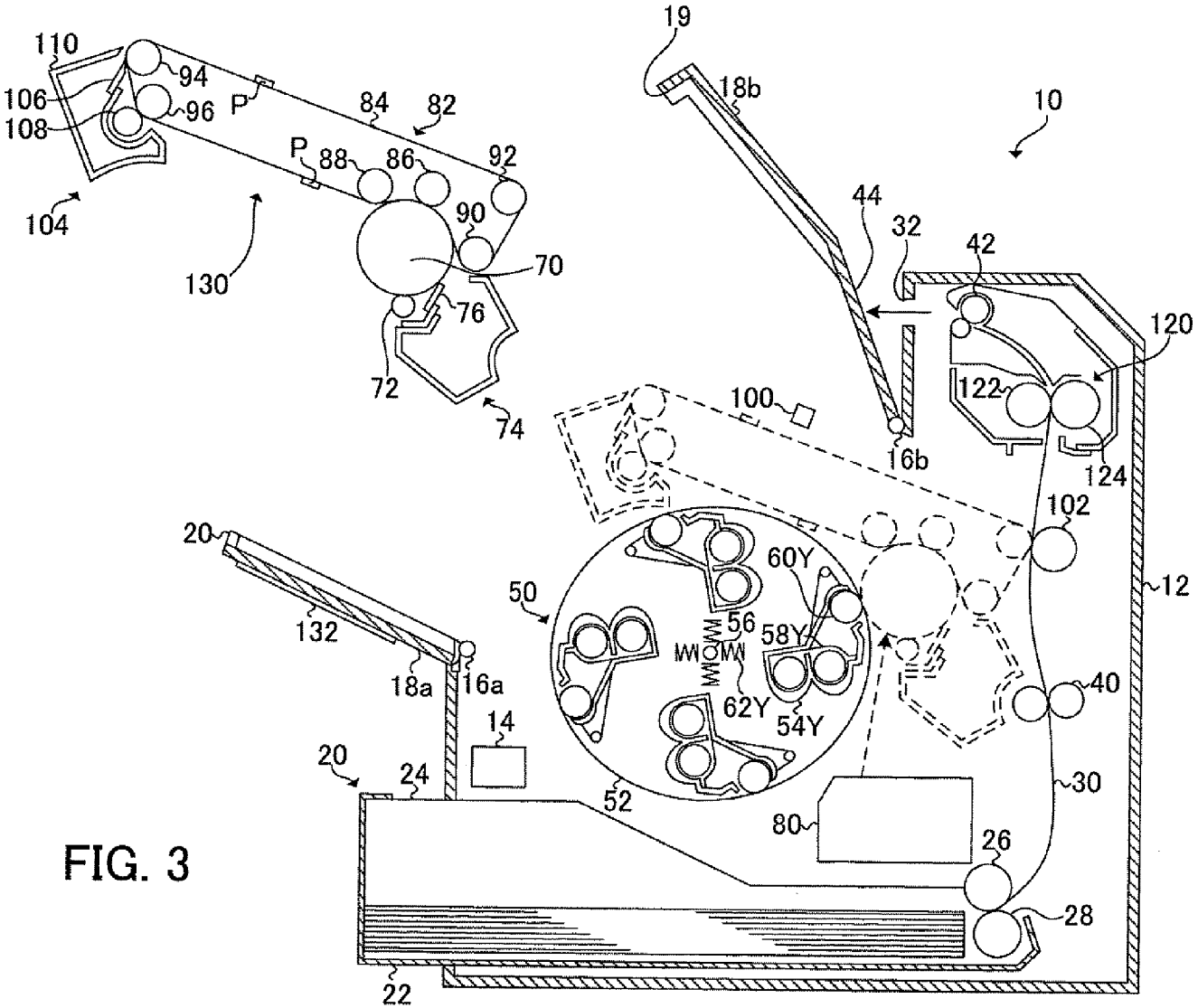
FIG. 3 is a view illustrating a state where an image forming unit 130 is removed from an image forming apparatus main body 12.

FIG. 1 illustrates an entire configuration of an image forming apparatus 10 according to the exemplary embodiment of the present invention. The image forming apparatus 10 has an image forming apparatus main body 12 which has a controller 14 controlling every part of the image forming apparatus 10. In the front side of the image forming apparatus main body 12 (the left side face in FIG. 1), an open-close cover 18*a* turnable around a pivot 16*a* is disposed. Further, in the upper side of the image forming apparatus main body 12, an open-close cover 18*b* turnable around a pivot 16*b* is disposed. The open-close covers 18*a* and 18*b* provide the opening and closing of an opening 19 as shown in FIG. 3. An interlock switch 20 serving as an open-close detector is disposed in the free end side of the open-close cover 18*a*, and by single-use allows the detection of the opening and closing state of the open-close covers 18*a* and 18*b*. A recording medium supply unit 21 which is e.g. an one-stage unit is disposed in the lower part of the image forming apparatus main body 12.

The recording medium supply unit 21 has a recording medium supply unit main body 22 and a recording medium supply cassette 24 storing a recording medium. In the innermost end and approximate upper part of the recording medium supply cassette 24, a feed roller 26 feeding a recording medium and a separation roller 28 separating a fed recording medium are disposed.

A transport path 30 being a recording medium passage from the feed roller 26 to an exit 32 is positioned at the approximate backside of the image forming apparatus main body 12 (the right side face in FIG. 1), and has an approximate vertical part from the recording medium supply unit 21 to a fixing device 120 to be described later. A secondary transfer roller 102 and a secondary transfer backup roller 92 to be described later are arranged in upstream side of the fixing device 120. Further, a registration roller 40 is arranged in the upstream side of the secondary transfer roller 102 and the secondary transfer backup roller 92. Furthermore, an exit roller 42 is arranged in the vicinity of the exit 32 along the transport path 30.

Thus, an uppermost recording medium which is fed by the feed roller 26 from the recording medium supply cassette 24 of the recording medium supply unit 21 is separated by the separation roller 28 and is guided to the transport path 30. The recording medium led to the transport path 30 is temporarily stopped with the registration roller 40, and is subjected to the transferring of a toner image by passing between the secondary transfer roller 102 and the secondary transfer backup roller 92 at predetermined timing. Subsequently, the transferred toner image is fixed on the recording medium with the fixing device 120, and further the recording medium is exited through the exit 32 toward an exit part 44, positioned on an upper part of the open-close cover 18, with an exit roller 42. The exit part 44 is configured so as to be tilted upward from the exit 32 side toward the front side of the image forming apparatus 10 (the left side face in FIG. 1).

A rotary developing device 50 is disposed at e.g. an approximate central part of the image forming apparatus main body 12. The rotary developing device 50 has a developing device main body 52. The developing device 52 has developing units 54Y, 54M, 54C, and 54K respectively forming each of four color toner images of yellow, magenta, cyan, and black developers. The rotary developing device 50 rotates around a center 56 in the left direction (counterclockwise rotation in FIG. 1). As a typical example of the exemplary embodiment, components forming a yellow toner image are denoted by reference numerals in FIG. 1.

Each of developing units 54Y, 54M, 54C, and 54K is applied in two component development method, and has a developer supply member (not shown) supplying a toner to developing containers 58Y, 58M, 58C, and 58K and developing rollers 60Y, 60M, 60C, and 60K. The developing units 54Y, 54M, 54C, and 54K are respectively pressed with each of elastic members 62Y, 62M, 62C, and 62K consisting of e.g. a coil spring in a normal direction of the developing device main body 52.

The rotary developing device 50 is arranged so as to contact with an image carrier 70 consisting of e.g. a photoreceptor. The developing rollers 60Y, 60M, 60C, and 60K are respectively arranged in the state where a part of the circumference of each developing roller 60Y, 60M, 60C, and 60K radially juts out from the circumference of the developing device main body 52 by e.g. 2 mm, but the juts do not abut on the image carrier 70. Further, each of the developing rollers 60Y, 60M, 60C, and 60K has, at both ends of the axis, a tracking roller whose diameter is slightly bigger than the diameter of the developing rollers 60Y, 60M, 60C, and 60K (not shown) to rotates on the same axis as the developing rollers 60Y, 60M, 60C, and 60K. That is, when the tracking roller abuts on a flange disposed at both ends of the axis of the image carrier 70, a given interspace is formed between each of the developing rollers 60Y, 60M, 60C, and 60K and the image carrier 70, and then, a latent image formed on the image carrier 70 is developed with each color toners.

Down the image carrier 70, a charging device 72 consisting of e.g. a charging roller and uniformly charging the image carrier 70 is disposed. Further an image carrier cleaner 74 is positioned short of the charging device 72 in the rotating direction of the image carrier 70 so as to contact with the image carrier 70. The image carrier cleaner 74 consists of e.g. a cleaning blade 76 for scraping off toner particles remaining on the image carrier 70 and a waste toner bottle 78 for collecting the scrapped toner particles.

Down the rotary developing device 50, an optical writing device 80 for writing a latent image to the image carrier 70 charged by the charging device 72, with beam such as laser, is arranged. Above the rotary developing device 50, an intermediate transfer device 82 which allows a toner image visualized with the rotary developing device 50 to be firstly transferred at a primary transfer position and subsequently sends the transferred toner image to a secondary transfer position is disposed.

The intermediate transfer device 82 consists of e.g. an intermediate transfer member 84 such as an intermediate transfer belt, a primary transfer roller 86, a wrap-in roller 88, a wrap-out roller 90, a secondary transfer backup roller 92, a scraper backup roller 94, and a brush backup roller 96.

The intermediate transfer member 84 having e.g. elasticity is approximately flatly tightened so as to have a longer side and a shorter side above the rotary developing device 50. The longer side part of the upper surface of the intermediate transfer member 84 is formed so as to be approximate parallel relative to the exit part 44 disposed in the upper part of the image forming apparatus main body 12. Further on the under side of the longer side of the intermediate transfer member 84, a primary transfer part which contacts the image carrier 70 in a wrapping manner between the wrap-in roller 88, arranged upstream of the primary transfer roller 86, and a wrap-out roller 90, arranged downstream of the primary transfer roller 86 is disposed. The intermediate transfer member 84 wraps around the image carrier 70 only over a predetermined range to rotate according to the rotary of the image carrier 70.

As described above, the intermediate transfer member 84 is subjected to the primary transfer by superposing each color toner image, e.g. yellow, magenta, cyan, and black, of the image carrier 70, in order with the primary transfer roller 86. The toner image superposed by the primary transfer is transported toward a secondary transfer roller 102 to be described later.

Note that the wrap-in roller 88 and the wrap-out roller 90 are separated from the image carrier 70.

In the back side of the intermediate transfer member 84 (the right side face in FIG. 1), a flat portion (the shorter side part) is formed by the wrap-out roller 90 and the secondary transfer backup roller 92. The flat portion serving as a secondary transfer part faces to the transfer path 30.

The scraper backup roller 94 allows a scraper 106 to be descried later to scrape off a toner particles remaining on the intermediate transfer member 84 after a secondary transfer. The brush backup roller 96 allows the brush roller 108 to be described later to scrap off a toner particles remaining on the intermediate transfer member 84 after the secondary transfer.

An intermediate transfer sensor 100 such as a reflective photosensor is disposed above the longer side of the intermediate transfer member 84. The intermediate transfer sensor 100 reads plural marks, e.g. two position marks P arranged on the intermediate transfer member 84 to detect to the rotary motion and the rotary direction of the intermediate transfer member 84. That is, the intermediate transfer sensor 100 determines the rotary motion of the intermediate transfer member 84 from the interval of time between the detection of a first position mark P and the detection of a second position mark P.

The secondary transfer backup roller 92 of the intermediate transfer device 82 and the secondary transfer roller 102 are arranged so as to sandwich the transport path 30 and to be opposite each other. The secondary transfer position of the secondary transfer part is between the secondary transfer roller 102 and the secondary transfer backup roller 92, and at the secondary transfer position, the secondary transfer roller 102 performs the secondary transfer by using the toner image superposed on the intermediate transfer 84 by the primary transfer, onto a recording medium with the secondary transfer back-up roller 92. While the intermediate transfer member 84 rotates e.g. three times, that is, during the transportation of three toner images with yellow, magenta, and cyan color toners, the secondary transfer roller 102 separates from the intermediate transfer member 84. Further, after completion of transfer of the black toner, the secondary transfer roller 102 contacts the intermediate transfer member 84.

An intermediate transfer cleaner 104 is disposed so as to contact with the end of the intermediate transfer 84, which is opposite the one end adjacent to the image carrier 70. The intermediate transfer cleaner 104 consists of e.g. a scraper 106 for scraping a toner particles remaining on the intermediate transfer member 84 after the secondary transfer to clean the intermediate transfer member 84, a brush roller 108 for further scraping toner particles remaining following the cleaning by the scraper 106, and a waste toner bottle 110 for collecting the toner particles scraped by the scraper 106 and the brush roller 108.

The scraper 106 is made of e.g. a thin sheet of a stainless steel, and is supplied the opposite polarity relative to the toner voltage supply. The brush roller 108 is made of e.g. an acrylic brush subjected to conductive treatment. The scraper 106 and the brush roller 108 are arranged so as to be separate from the intermediate transfer member 84 during the transportation of the toner image by the intermediate transfer member 84, and at a predetermined timing contact the intermediate transfer member 84 in an integrated manner.

A fixing device 120 is arranged above the secondary transfer position. The fixing device 120 has a heating roller 122 and a pressure roller 124 for transporting a recording medium, on which the toner image is fixed after completion of the secondary transfer, toward the exit roller 42.

An image forming unit 130 is configured by integrating the intermediate transfer device 82, the image carrier 70, the charging device 72, the image carrier cleaner 74, and the intermediate transfer cleaner 104. The image forming unit 130 is arranged below proximal the exit part 44 of the open-close cover 18*b*, and is removable against the image forming apparatus main body 12 with the open-close cover 18*a* and 18*b* opened or closed.

A touch panel 132 for inputting and displaying by and to an operator is disposed in the front side of the image forming apparatus main body 12 (The left side face in FIG. 1). The touch panel 132 is controlled by a user interface (UI) 140 to be described later.

If an image is continuously formed on a recording medium with a resolution that is below a predetermined value, since each developer of the developing units 54Y, 54M, 54C, and 54K circulate long time, and has high charge, the toner on the image carrier 70 deteriorates and thereby the image deterioration causes. The image forming apparatus 10 is configured so that the deteriorated toner is exited from the developing units 54Y, 54M, 54C, and 54K for preventing the image deterioration.

The image forming apparatus 10 is configured so that the deteriorated toner is exited (removed) from each of the developing units 54Y, 54M, 54C, and 54K, for instance, by using a controller 14 which provides the superposition of each predetermined color toner image on a predetermined section of the image carrier 70 and controls the image carrier cleaner 74 to scrap the toner image with the deteriorated toner particles.

The image forming apparatus 10 further may be configured so that the deteriorated toner is exited (removed) from each of the developing units 54Y, 54M, 54C, and 54K, by using a controller 14 which provides the superposition of each predetermined color toner image on a predetermined section of the image carrier 70 and controls the image carrier cleaner 104 to scrap the toner image with the deteriorated toner particles.

Figure 2:
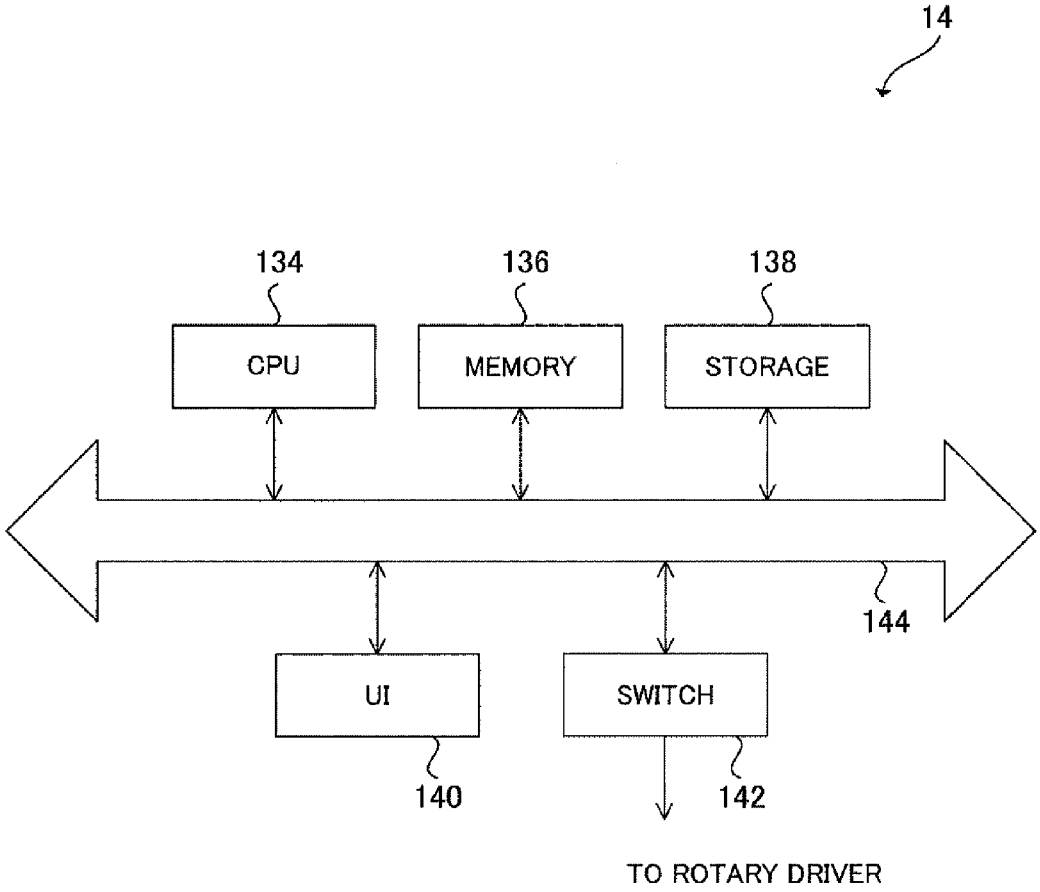
FIG. 2 is a diagram illustrating a hardware configuration of a controller 14 disposed in the image forming apparatus 10.

FIG. 2 shows a hardware configuration of the controller 14. The controller 14 has a CPU 134, a memory 136, a storage device 138 such as a hard-disk drive, the UI 140, and a switch 142 for turning on or off a rotary driver 206 to be described later. The above components are connected to each other via a bus 144 so as to be capable of inputting and outputting information each other.

Next, the attachment and removal of the image forming unit 130 will be described below.

FIG. 3 shows a diagram illustrating the image forming unit 130 is removed from the image forming apparatus main body 12. The image forming unit 130 is removed through the opening 19, which is opened at the time where the open-close covers 18*a* and 18*b* entirely open in order, in a diagonally forward direction of the image forming apparatus main body 12 (The left diagonally upward side in FIG. 3).

Figure 4:
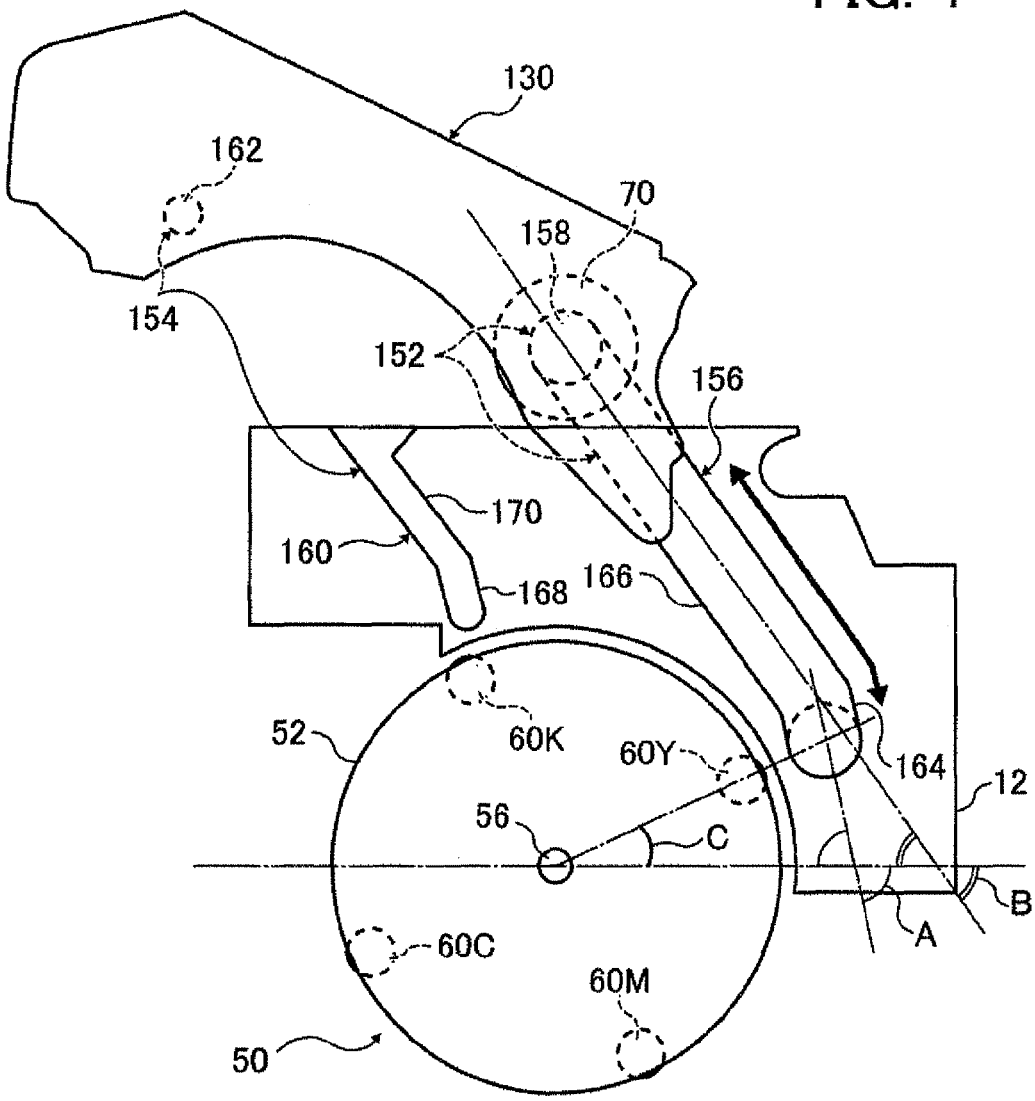
FIG. 4 is an explanatory view explaining the attachment and removal of the image forming unit 130.

FIG. 4 shows a configuration diagram of the attachment and removal of the image forming unit 130. The image forming unit 130 is attached or removed to or from the image forming unit main body 12 by a main guide unit 152 and an auxiliary guide unit 154 in a predetermined direction.

The main guide unit 152 consists of e.g. a guide groove 156 disposed in the image forming apparatus main body 12 and a main projection 158 disposed in the image forming unit 130. The main projection 158 is formed, for instance, cylindrically on the same axis as the image carrier 70, so as to fit in the guide groove 156, and move along the guide groove 156.

The auxiliary guide unit 154 consists of e.g. an auxiliary groove 160 disposed in the image forming apparatus main body 12 and an auxiliary projection 162 disposed in the image forming unit 130. The auxiliary projection 162 is formed, for instance, cylindrically so as to fit in the auxiliary groove 160 and move along the auxiliary groove 160. The auxiliary groove 160, in which the upper side is wider than the lower side, facilitates fitting of the auxiliary projection 162 to the auxiliary groove 160.

The guide groove 156 has a contacting and departing guide groove 164 formed in the lower part of the guide groove 156 at an angle A from the horizontal, and a displacing guide groove 166 formed in the upper part of the guide groove 156 at an angle B from the horizontal. The auxiliary groove 160 has a contacting and departing auxiliary guide groove 168 formed in the lower part of the auxiliary groove 160 at an angle A from the horizontal, and a displacing auxiliary guide groove 170 formed in the upper part of the auxiliary groove 160 at an angle B from the horizontal. The angle A is e.g. 70-degree, and the angle B is e.g. 55-degree. Therefore, the main projection 158 and the auxiliary projection 162 respectively move along the contacting and departing guide groove 164 and the contacting and departing auxiliary guide groove 168 each other, thereby the image forming unit 130 in the approximate tangential direction of the rotary developing device 50 is moved toward the direction for contacting and departing to and from the image forming apparatus main body 12.

In addition, the main projection 158 and the auxiliary projection 162 respectively move along the displacing guide groove 166 and the displacing auxiliary guide groove 170 each other, thereby the image forming unit 130 is moved toward the approximate tangential direction in which the image forming unit 130 passes thorough the developing position of the rotary developing device 50.

As described above, the main projection 158 and the auxiliary projection 162 respectively move along the guide groove 156 and the auxiliary groove 160 each other, thereby the image forming unit 130 is attached or removed to or from the image forming apparatus main body 12 in a predetermined posture in the approximate tangential direction having the developing portion of the rotary developing device 50.

The lower end of the guide groove 156 is formed so that the shaft (center) corresponding to both of the image carrier 70 and the main projection 158 is positioned in the normal line extending from a center 56 of the rotary developing device 50 at an angle C from the horizontal, and the image carrier 70 and the main projection 158 are received thereon. The angle C is e.g. 25-degree. Thus, the image carrier 70 is located at a predetermined developable position with the main projection 158 received on the lower end of the guide groove 156, so as to avoid displacement caused by the press of the rotary developing device 50.

In the removal of the image forming unit 130, the open-close covers 18*a* and 18*b* open together, and as a result, the opening 19 is entirely opened.

When the image forming unit 130 is located at a predetermined developable position (an appropriate position), the open-close covers 18*a* and 18*b* are capable of closing. That is, the open-close covers 18*a* and 18*b* appropriately close, and an interlock switch 20 detects the completion of the closing of the open-close covers 18*a* and 18*b* when the image forming unit 130 is located at an appropriate position.

When the image forming unit 130 is inappropriately located, it is configured that the open-close covers 18*a* and 18*b* are unable to appropriately close due to the insufficient attachment of the image forming unit 130. That is, when the image forming unit 130 is inappropriately located, the interlock switch 20 detects the insufficient closing of the open-close covers 18*a* and 18*b*.

When the open-close covers 18*a* and 18*b* open, a recording medium placed on the exit part 44 never falls down because one end of the recording medium moving relative to opening or closing motion of the open-close cover 18*b* is supported at a pivot 16*b* side of the open-close cover 18*b* (the exit part 44).

The attachment of the image forming unit 130 is performed in the reverse procedure to the removal of the image forming unit 130.

Next, a perimeter configuration of a portion where the image forming apparatus main body 12 and the image carrier 70 of the image forming unit 130 connect together will be described.

Figure 5:
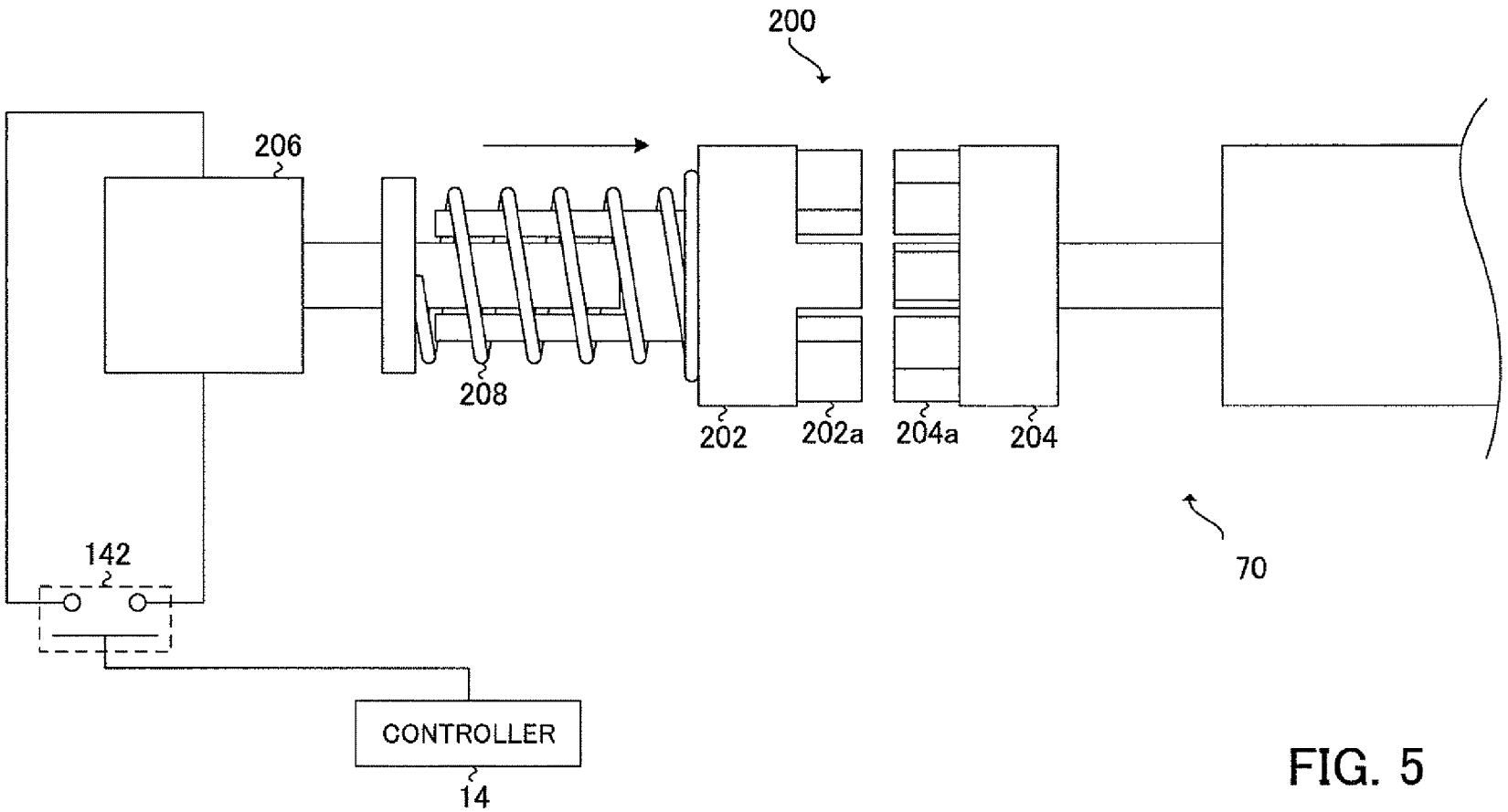
FIG. 5 is a view illustrating a periphery of the coupling part between the image forming apparatus main body 12 and an image carrier 70.
Figure 6:
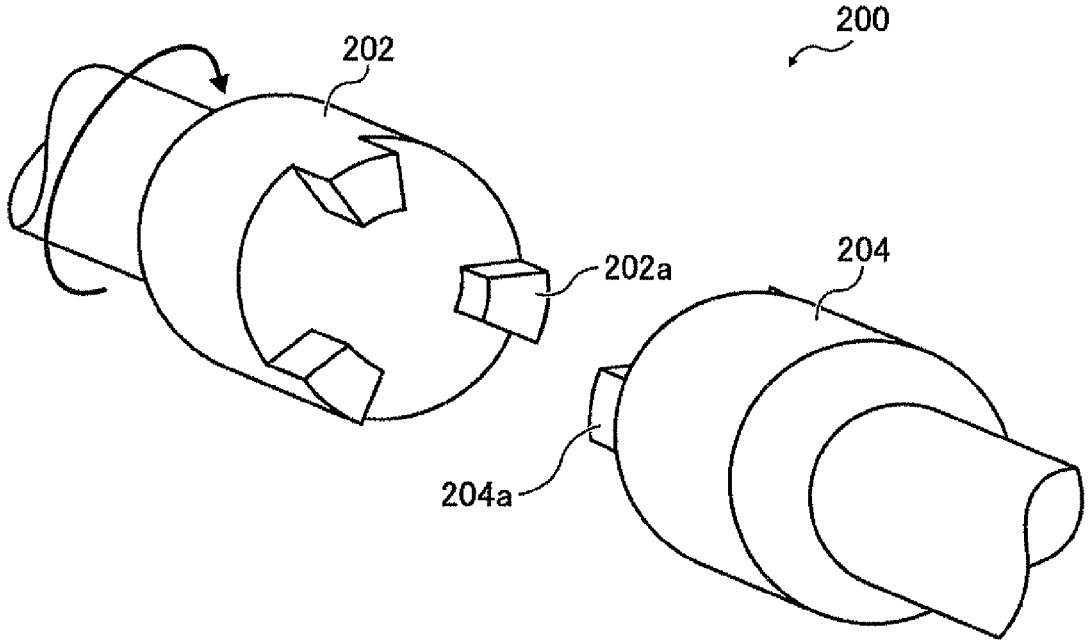
FIG. 6 is a perspective view of a coupling 200.

FIG. 5 shows a diagram of the perimeter configuration of the coupling portion where the image forming apparatus main body 12 and the image carrier 70 connect together, and FIG. 6 shows a perspective view of a coupling 200.

The image carrier 70 of the image forming unit 130 has at least a part of the coupling 200 being an example of a coupling device associated with the image forming apparatus main body 12. The coupling 200 has a coupling member 202 disposed in the image forming apparatus main body 12 and a coupled member 204 disposed in the image carrier 70. The coupling member 202 and the coupled member 204 are removably coupled together.

When a coupling projected part 202*a* of the coupling member 202 and a coupled projected part 204*a* of the coupled member 204 abut together at the laterals facing in a circumferential direction of both of the coupling member 202 and the coupled member 204, the coupling between the coupling member 202 and the coupled member 204 occurs.

In contrast, when the coupling projected part 202*a* and the coupled projected part 204*a* abut together at the surfaces facing in the rotary axis direction of both the coupling member 202 and the coupled member 204, the coupling between the coupling member 202 and the coupled member 204 is inappropriate.

The coupling member 202 is connected to a rotary driver 206 providing the rotation of the coupling member 202. At the coupling 200, the rotation driven by the rotary driver 206 is transmitted to the image carrier 70.

The rotary driver 206 consists of e.g. a DC motor or the like, and is connected to the switch 142 for turning on or off a rotary driver 206 by controlled with the controller 14. When the switch 142 is turned on, the rotary driver 206 drives to rotate the coupling member 202 at a certain speed. When the switch 142 is turned off, the rotary driver 206 stops the driving. After the stop of the driving, the coupling member 202 rotates several times (around 1 to 5 rotations) due to an inertial force.

An urging part 208 such as a spring is mounted on the coupling member 202. The urging part 208 is configured so as to work with opening or closing motion of the open-close covers 18*a* and 18*b*. Specifically, when the open-close covers 18*a* and 18*b* close after the completion of the appropriate attachment of the image forming unit 130, the urging part 208 urges the coupling member 202 in the direction of the image carrier 70 (the direction of the coupled member 204) in conjunction with the closing. When the open-close covers 18*a* and 18*b* open, the urging part 208 stops urging the coupling member 202 in the direction of the image carrier 70.

When the rotary driver 206 drives and subsequently stops the driving during the closing of the open-close covers 18*a* and 18*b*, the coupling member 202 is urged in the direction of the coupled member 204 to rotate due to the inertial force.

During the rotation due to the inertial force, the coupling member 202 has a rotary speed which is slower than the rotary speed during the rotation driven by the rotary driver 206. Accordingly, compared with the case where the coupling member 202 rotates by the driving of the rotary driver 206, the coupling member 202 easily engages to the coupled member 204 in the case where the coupling member 202 rotates due to the inertial force. That is, the coupling portion and surrounding components thereof are configured so as to avoid a situation that the coupling member 202 rotates with the coupling projected part 202*a* and the coupled projected part 204*a* abutting together at the surfaces facing in the rotary axis direction of both the coupling member 202 and the coupled member 204, i.e. an idling.

Next, the operation in the mounting of the image forming unit 130 will be described below.

Figure 7:
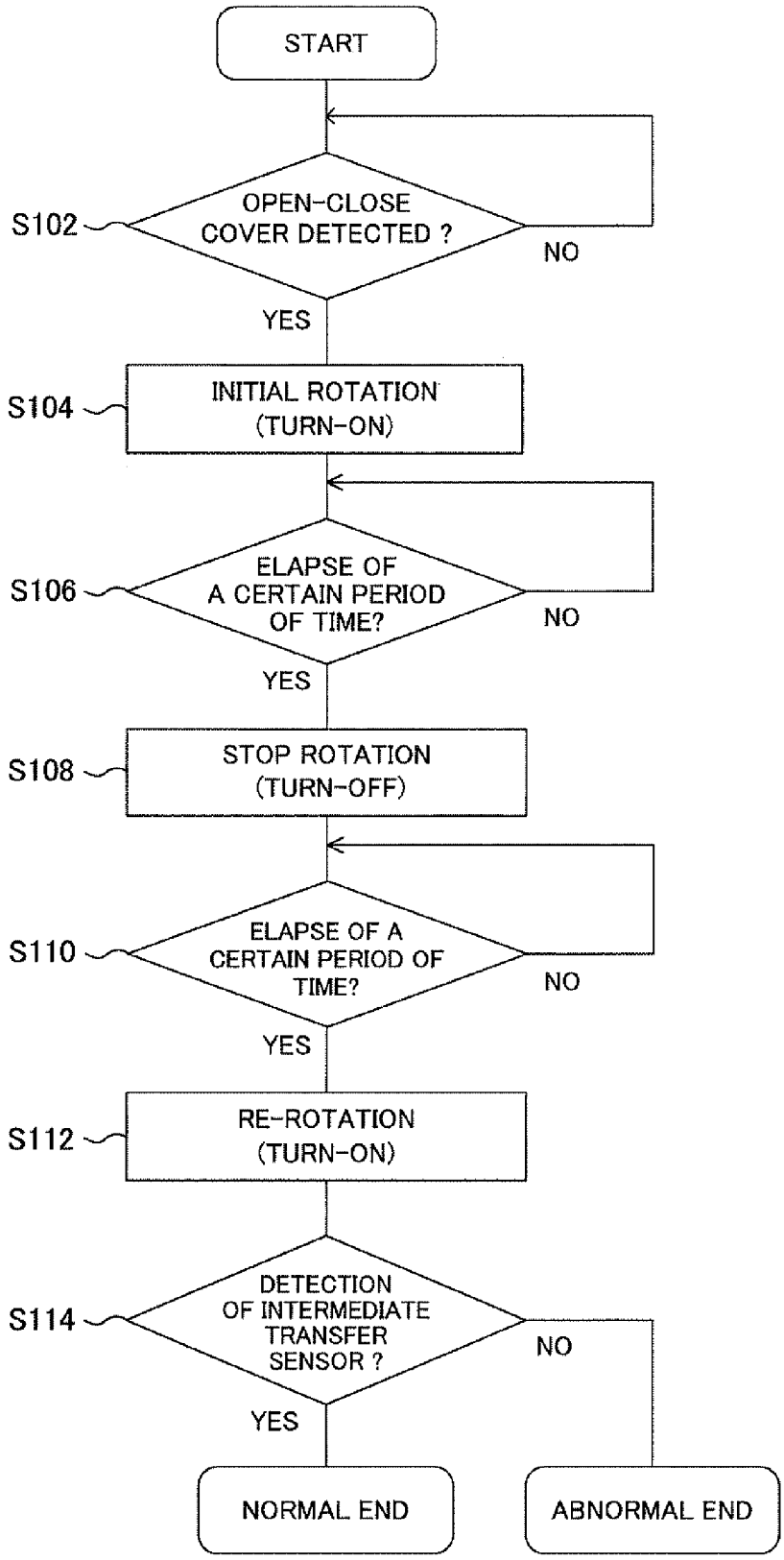
FIG. 7 is a flowchart of a first exemplary embodiment according to the present invention that illustrates an operation (S10) executed by a controller 14 in mounting of the image forming unit 130.

FIG. 7 illustrates a flowchart of the operation executed by the controller 14 when the image forming unit 130 is mounted (S10).

In a step 102 (S102), the controller 14 receives the determination, whether the open-close covers 18*a* and 18*b* close, from the interlock switch 20, and then waits until the open-close covers 18*a* and 18*b* close. When the open-close covers 18*a* and 18*b* close, the processing is advanced to a step 104 (S104).

In the step 104 (S104), the controller 14 turns the switch 142 on. Thereby, the rotary driver 206 drives to allow the coupling member 202 to rotate (an initial rotation).

In a step 106 (S106), the controller 14 determines the elapse of a certain period of time, and then waits until a certain period of time elapses. When the controller 14 determines that a certain period of time elapses, the processing is advanced to a step 108 (S108). The certain period of time means a time while, for instance, the coupling member 202 rotates several times (around 1 to 5 times) by the rotary driver 206.

In the step 108 (S108), the controller 14 turns the switch 142 off. Thereby, the rotary driver 206 stops driving, and the coupling member 202 rotates due to the inertial force.

In a step 110 (S110), the controller 14 determines the elapse of a certain period of time, and waits until the predetermined time elapses. After the determination that the predetermined time elapses, the processing is advanced to a step 112 (S112). The predetermined time in the step 110 means a stopping time until, for instance, the coupling member 202 stops rotating due to the inertial force.

In the step 112 (S112), the controller 14 turns the switch 142 on again. Thereby, the rotary driver 206 drives to allow the coupling member 202 to rotate (re-rotation).

In a step 114 (S114), the controller 14 receives the determination from the intermediate transfer sensor 100 whether or not the intermediate transfer member 84 rotates. When the determination that the intermediate transfer member 84 is rotating has been done, that is, when the coupling member 202 and the coupled member 204 connect together, the operation (S10) of the controller 14 in the mounting of the image forming unit 130 normally exits.

On the other hand, when the determination that the intermediate transfer member 84 is rotating has not been done, that is, when the coupling member 202 and the coupled member 204 loosely connect, the controller 14 make the touch panel 132 to display the notice of the error with the UI 204.

The exemplary embodiment herein described is configured so that the controller 14 allows the rotary driver 206 to drive in the manner where the determination that the open-close covers 18*a* and 18*b* close is detected by the interlock switch 20 (S102), but not to be limited to the configuration, the driving in the step 104 (S104) may start by operating the touch panel 132 by an operator.

Second Exemplary Embodiment

Next, the second exemplary embodiment will be described below.

Figure 8:
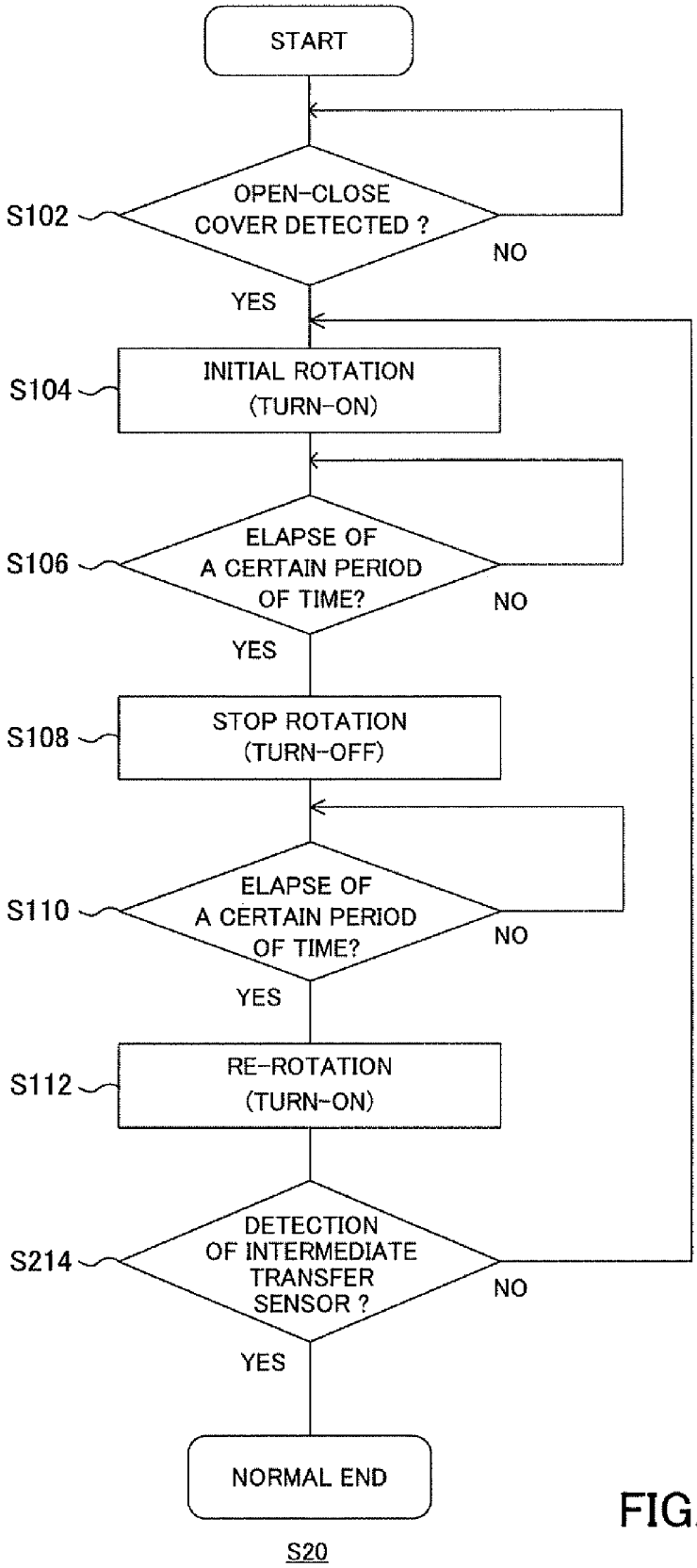
FIG. 8 is a flowchart of a second exemplary embodiment according to the present invention that illustrates an operation (S20) executed by a controller 14 in mounting the image forming unit 130.

FIG. 8 illustrates a flowchart of the operation executed by the controller 14 (S20) when the image forming unit 130 is mounted. In the second exemplary embodiment, the processing in a step 214 is executed after the processing in the above steps S102 to S112.

In the step 214 (S214), the controller 14 receives the determination from the intermediate transfer sensor 100 whether or not the intermediate transfer member 84 rotates. When the intermediate transfer member 84 is rotating, that is, when the coupling member 202 and the coupled member 204 connect together, the operation (S20) by the controller 14 in the mounting of the image forming unit 130 normally exits.

On the other hand, when the intermediate transfer member 84 is not rotating, that is, when the coupling member 202 and the coupled member 204 loosely connect, the processing is returned to the step 104 (S104).

In the second exemplary embodiment, the processing in the steps 104 to 112 (S104-S112) and the step 214 (S214) repeat until the determination that the intermediate transfer member 84 rotates has done, that is, until the coupling member 202 and the coupled member 204 connect together.

The foregoing description of the exemplary embodiment of the present invention has been provided for the purposes of illustration and description. It is not intended to be exhaustive or to limit the invention to the precise forms disclosed. Obviously, many modification and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suites to the particular use contemplated. It is intended that the scope of the invention be defined by the following claims and their equivalents.

What is claimed is:

1. An image forming apparatus comprising:

an image forming apparatus main body;

a driven member removably disposed in the image forming apparatus main body;

a rotary driver that rotates by current flowing, and after the blockage of the current flowing, continuously rotates due to an inertial force;

a coupling part that has a driving-side member and a driven-side member, wherein when the driven-side member is mounted to the image forming apparatus main body, the driving-side member and a driven-side member are facing each other, and when the driving-side member and the driven-side member engage each other in the rotating direction, the rotary driver and the driven-side member are coupled to transmit the rotation of the rotary driver to the driven-side member;

a controller that controls so that, when the driven-side member is mounted to the image forming apparatus main body, the current flows to the rotary driver, and after the elapse of a certain period of time the current flow to the rotary driver is blocked;

an open-close part that is disposed in the image forming apparatus main body so as to open and close freely, and allows the driven member to be attached and removed to and from the image forming apparatus main body; and an open-close detector that detects the opening and closing of the open-close part, wherein the controller further controls, so that when the open-close detector detects that the open-close part closes, the current flows to the rotary driver, and after the elapse of a certain period of time, the current flow to the rotary driver is blocked.

2. The image forming apparatus according to claim 1, wherein the driven member has an intermediate transfer member, further comprising a rotary detector that detects a rotation of the intermediate transfer member, wherein the controller controls, so that when the rotary detector detects that the rotation of the intermediate transfer member stops, the current flows to the rotary driver, and after the elapse of a certain period of time, the current flow to the rotary driver is blocked.

3. An image forming apparatus comprising:

an image forming apparatus main body;

a driven member removably disposed in the image forming apparatus main body, the driven member having an intermediate transfer member;

a rotary driver that rotates by current flowing, and after the blockage of the current flowing, continuously rotates due to an inertial force;

a coupling part that has a driving-side member and a driven-side member, wherein when the driven-side member is mounted to the image forming apparatus main body, the driving-side member and a driven-side member are facing each other, and when the driving-side member and the driven-side member engage each other in the rotating direction, the rotary driver and the driven-side member are coupled to transmit the rotation of the rotary driver to the driven-side member;

a controller that controls so that, when the driven-side member is mounted to the image forming apparatus main body, the current flows to the rotary driver, and after the elapse of a certain period of time the current flow to the rotary driver is blocked; and a rotary detector that detects a rotation of the intermediate transfer member, wherein the controller further controls, so that when the rotary detector detects that the rotation of the intermediate transfer member stops, the current flows to the rotary driver, and after the elapse of a certain period of time, the current flow to the rotary driver is blocked.

4. The image forming apparatus according to claim 3, wherein the controller provides the current flowing to the rotary driver when the rotation due to the inertial force in the rotary driver stops.

5. An image forming apparatus comprising:

an image forming apparatus main body;

a driven member removably disposed in the image forming apparatus main body;

a rotary driver that rotates by current flowing, and after the blockage of the current flowing, continuously rotates due to an inertial force;

a coupling part that has a driving-side member and a driven-side member, wherein when the driven-side member is mounted to the image forming apparatus main body, the driving-side member and a driven-side member are facing each other, and when the driving-side member and the driven-side member engage each other in the rotating direction, the rotary driver and the driven-side member are coupled to transmit the rotation of the rotary driver to the driven-side member;

a controller that controls so that, when the driven-side member is mounted to the image forming apparatus main body, the current flows to the rotary driver, and after the elapse of a certain period of time the current flow to the rotary driver is blocked;

an open-close part that is disposed in the image forming apparatus main body so as to open and close freely, and allows the driven member to be attached and removed to and from the image forming apparatus main body; and an open-close detector that detects the opening and closing of the open-close part, wherein the controller further controls, so that when the open-close detector detects that the open-close part closes, the current flows to the rotary driver, and after the elapse of a certain period of time, the current flow to the rotary driver is blocked, and the controller provides the current flowing to the rotary driver when the rotation due to the inertial force in the rotary driver stops.

* * * * *